US009979081B2

(12) United States Patent
Berezin et al.

(10) Patent No.: US 9,979,081 B2
(45) Date of Patent: May 22, 2018

(54) MULTIBAND ANTENNA AND SLOTTED GROUND PLANE THEREFORE

(71) Applicant: GALTRONICS CORPORATION LTD., Tiberias (IL)

(72) Inventors: Anatoly Berezin, Tiberias (IL); Yaniv Ziv, Tiberias (IL); Haim Yona, Tiberias (IL); Sharon Harel, Tiberias (IL)

(73) Assignee: GALTRONICS CORPORATION LTD., Tiberias (IL)

( * ) Notice: Subject to any disclaimer, the term of this patent is extended or adjusted under 35 U.S.C. 154(b) by 258 days.

(21) Appl. No.: 14/254,477

(22) Filed: Apr. 16, 2014

(65) Prior Publication Data

US 2014/0313094 A1 Oct. 23, 2014

Related U.S. Application Data

(60) Provisional application No. 61/814,399, filed on Apr. 22, 2013, provisional application No. 61/894,964, filed on Oct. 24, 2013.

(51) Int. Cl.
*H01Q 1/52* (2006.01)
*H01Q 1/24* (2006.01)
(Continued)

(52) U.S. Cl.
CPC ..... *H01Q 1/521* (2013.01); *H01Q 1/246* (2013.01); *H01Q 9/16* (2013.01); *H01Q 21/08* (2013.01); *H01Q 21/24* (2013.01); *H01Q 21/28* (2013.01)

(58) Field of Classification Search
CPC ..... H01Q 21/062; H01Q 1/521; H01Q 21/28; H01Q 1/246; H01Q 21/08; H01Q 21/24; H01Q 9/16
(Continued)

(56) References Cited

U.S. PATENT DOCUMENTS 5,469,181 A * 11/1995 Yarsunas ..... H01Q 21/10 343/812
6,069,586 A * 5/2000 Karlsson ..... H01Q 1/523 343/700 MS
(Continued)

FOREIGN PATENT DOCUMENTS

CN 1624978 A 6/2005
CN 101548434 A 9/2009
(Continued)

OTHER PUBLICATIONS

U.S. Appl. No. 61/814,399, filed Apr. 22, 2013.
(Continued)

*Primary Examiner* — Dieu H Duong
*Assistant Examiner* — Bamidele A Jegede
(74) *Attorney, Agent, or Firm* — Lorenz & Kopf LLP

(57) ABSTRACT

A multiband antenna including a ground plane having at least one periphery, at least one non-radiative slot being formed along the at least one periphery, a first plurality of radiating elements mounted on the ground plane adjacent to the at least one periphery and radiating in a first frequency band and a second plurality of radiating elements mounted on the ground plane adjacent to the at least one periphery and radiating in a second frequency band, the second frequency band being higher than the first frequency band.

17 Claims, 12 Drawing Sheets

(51) Int. Cl.

| | |
|---|---|
| *H01Q 9/16* | (2006.01) |
| *H01Q 21/08* | (2006.01) |
| *H01Q 21/24* | (2006.01) |
| *H01Q 21/28* | (2006.01) |

(58) Field of Classification Search
USPC ..... 343/810, 817
See application file for complete search history.

(56) References Cited

U.S. PATENT DOCUMENTS

| | | | | |
|---|---|---|---|---|
| 6,195,063 | B1 * | 2/2001 | Gabriel | H01Q 1/523 343/700 MS |
| 6,229,496 | B1 * | 5/2001 | Eriksson | H01Q 1/246 343/789 |
| 6,333,720 | B1 * | 12/2001 | Gottl | H01Q 1/246 343/797 |
| 6,339,407 | B1 * | 1/2002 | Gabriel | H01Q 1/246 343/797 |
| 6,816,124 | B2 * | 11/2004 | Tillery | H01Q 1/246 343/795 |
| 6,831,615 | B2 * | 12/2004 | Gottl | H01Q 1/246 343/797 |
| 7,173,572 | B2 * | 2/2007 | Teillet | H01Q 1/246 343/795 |
| 7,629,939 | B2 * | 12/2009 | Deng | H01Q 1/246 343/799 |
| 7,777,684 | B2 | 8/2010 | Rao et al. | |
| 8,199,063 | B2 * | 6/2012 | Moon | H01Q 1/246 343/793 |
| 2003/0011529 | A1 * | 1/2003 | Gottl | H01Q 1/246 343/795 |
| 2005/0253769 | A1 * | 11/2005 | Timofeev | H01Q 1/246 343/797 |
| 2005/0264463 | A1 * | 12/2005 | Gottl | H01Q 1/246 343/797 |
| 2006/0114168 | A1 * | 6/2006 | Gottl | H01Q 1/246 343/797 |
| 2008/0036665 | A1 * | 2/2008 | Schadler | H01Q 1/42 343/700 MS |
| 2010/0238079 | A1 | 9/2010 | Ayatollahi et al. | |
| 2010/0265150 | A1 * | 10/2010 | Arvidsson | H01Q 1/246 343/837 |
| 2010/0321250 | A1 | 12/2010 | Sorvala et al. | |
| 2011/0043425 | A1 * | 2/2011 | Timofeev | H01Q 1/246 343/817 |
| 2011/0063190 | A1 * | 3/2011 | Ho | H01Q 1/526 343/912 |
| 2011/0309996 | A1 | 12/2011 | Abumrad et al. | |
| 2012/0044118 | A1 * | 2/2012 | Lee | H01Q 1/246 343/795 |
| 2012/0075155 | A1 * | 3/2012 | Lindmark | H01Q 1/246 343/797 |
| 2012/0280878 | A1 * | 11/2012 | Timofeev | H01Q 1/246 343/793 |

FOREIGN PATENT DOCUMENTS

| | | |
|---|---|---|
| WO | 2005/062422 | 7/2005 |
| WO | 2012/055883 | 5/2012 |
| WO | 2014/174510 | 10/2014 |

OTHER PUBLICATIONS

U.S. Appl. No. 61/894,964, filed Oct. 24, 2013.
An International Search Report and Written Opinion both dated Aug. 4, 2014, which issued during the prosecution of Applicant's PCT/IL2014/050353.
State Intellectual Property Office of the People's Republic of China, Office Action in Chinese Patent Application No. 201480022511.1 dated Mar. 1, 2017.
The International Bureau of WIPO, International Preliminary Report on Patentability for International Application No. PCT/IL2014/050353 dated Nov. 5, 2015.

* cited by examiner

MULTIBAND ANTENNA AND SLOTTED GROUND PLANE THEREFORE

REFERENCE TO RELATED APPLICATIONS

Reference is hereby made to U.S. Provisional Patent Application 61/814,399, entitled NOVEL ANTENNA STRUCTURES, filed Apr. 22, 2013, and to U.S. Provisional Patent Application 61/894,964, entitled ANTENNA WITH SLOTTED GROUND PLANE, filed Oct. 24, 2013, the disclosures of which are hereby incorporated by reference and priorities of which are hereby claimed pursuant to 37 CPR 1.78(a)(4) and (5)(i).

FIELD OF THE INVENTION

The present invention relates generally to antennas and more particularly to multiband antennas.

BACKGROUND OF THE INVENTION

Various types of multiband antennas are known in the art.

SUMMARY OF THE INVENTION

The present invention seeks to provide an improved multiband antenna having a slotted ground plane.

There is thus provided in accordance with a preferred embodiment of the present invention a multiband antenna including a ground plane having at least one periphery, at least one non-radiative slot being formed along the at least one periphery, a first plurality of radiating elements mounted on the ground plane adjacent to the at least one periphery and radiating in a first frequency band and a second plurality of radiating elements mounted on the ground plane adjacent to the at least one periphery and radiating in a second frequency band, the second frequency band being higher than the first frequency band.

Preferably, the at least one periphery includes a first longitudinal periphery and a second longitudinal periphery and the at least one non-radiative slot includes a first multiplicity of non-radiative slots formed along the first longitudinal periphery and a second multiplicity of non-radiative slots formed along the second longitudinal periphery.

Preferably, the ground plane includes a central planar portion having acutely angled edges, the acutely angled edges including the first and second longitudinal peripheries.

Preferably, each one of the first and second multiplicities of non-radiative slots includes at least a single row of slots.

Preferably, the at least single row of slots includes two parallel rows of slots.

In accordance with a preferred embodiment of the present invention the first plurality of radiating elements includes a plurality of dual-polarized dipole radiating elements.

In accordance with another preferred embodiment of the present invention, the second plurality of radiating elements includes a plurality of dual-polarized dipole radiating elements.

Preferably, the first and second pluralities of radiating elements are of the same type.

Alternatively, the first and second pluralities of radiating elements include different types of radiating elements.

Preferably, the first plurality of radiating elements operates over a frequency range of 690-960 MHz.

Preferably, the second plurality of radiating elements operates over a frequency range of 1710-2700 MHz.

In accordance with another preferred embodiment of the present invention, the first frequency band has a first associated beam width and the second frequency band has a second associated beam width, the at least one non-radiative slot widening the second beam width.

Preferably, the at least one non-radiative slot has a negligible influence on the first beam width.

Preferably, the first beam width is equal to or greater than 60°.

Preferably, the second beam width is equal to or greater than 65°.

In accordance with yet another preferred embodiment of the present invention, the multiband antenna also includes a dielectric element mounted on the ground plane and overlying the second plurality of radiating elements.

Preferably, a plurality of conductive isolation strips is formed on the dielectric element.

Preferably, dielectric element includes a generally rectangular element having a pair of wing-like extensions protruding therefrom.

Preferably, a thickness of the pair of wing-like extensions is greater than a thickness of the generally rectangular element.

In accordance with a further preferred embodiment of the present invention, the multiband antenna is housed by a radome.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
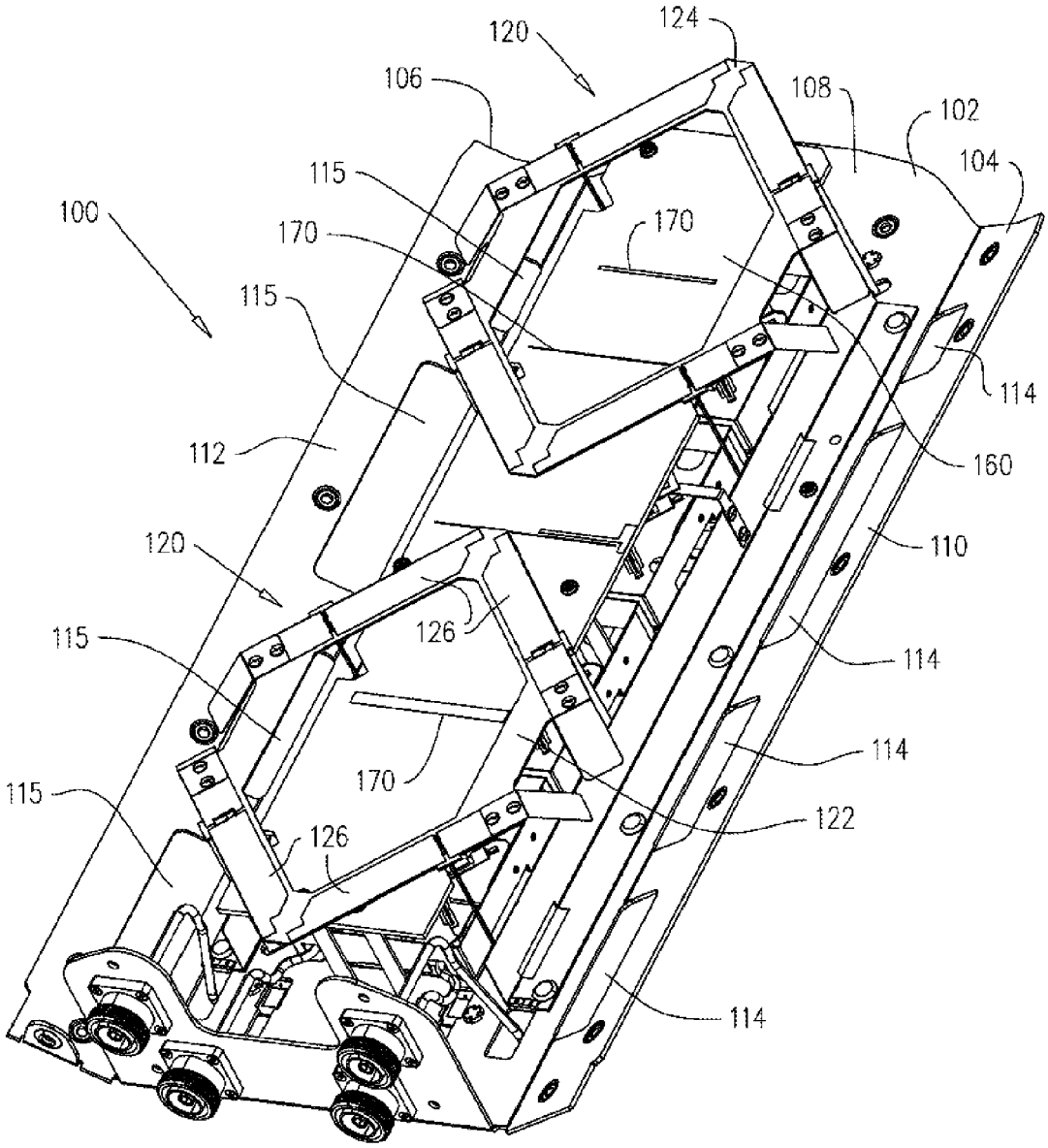
FIGS. 1A, 1B and 1C are simplified respective perspective, top and side view illustrations of a multiband antenna constructed and operative in accordance with a preferred embodiment of the present invention.
Figure 1B:
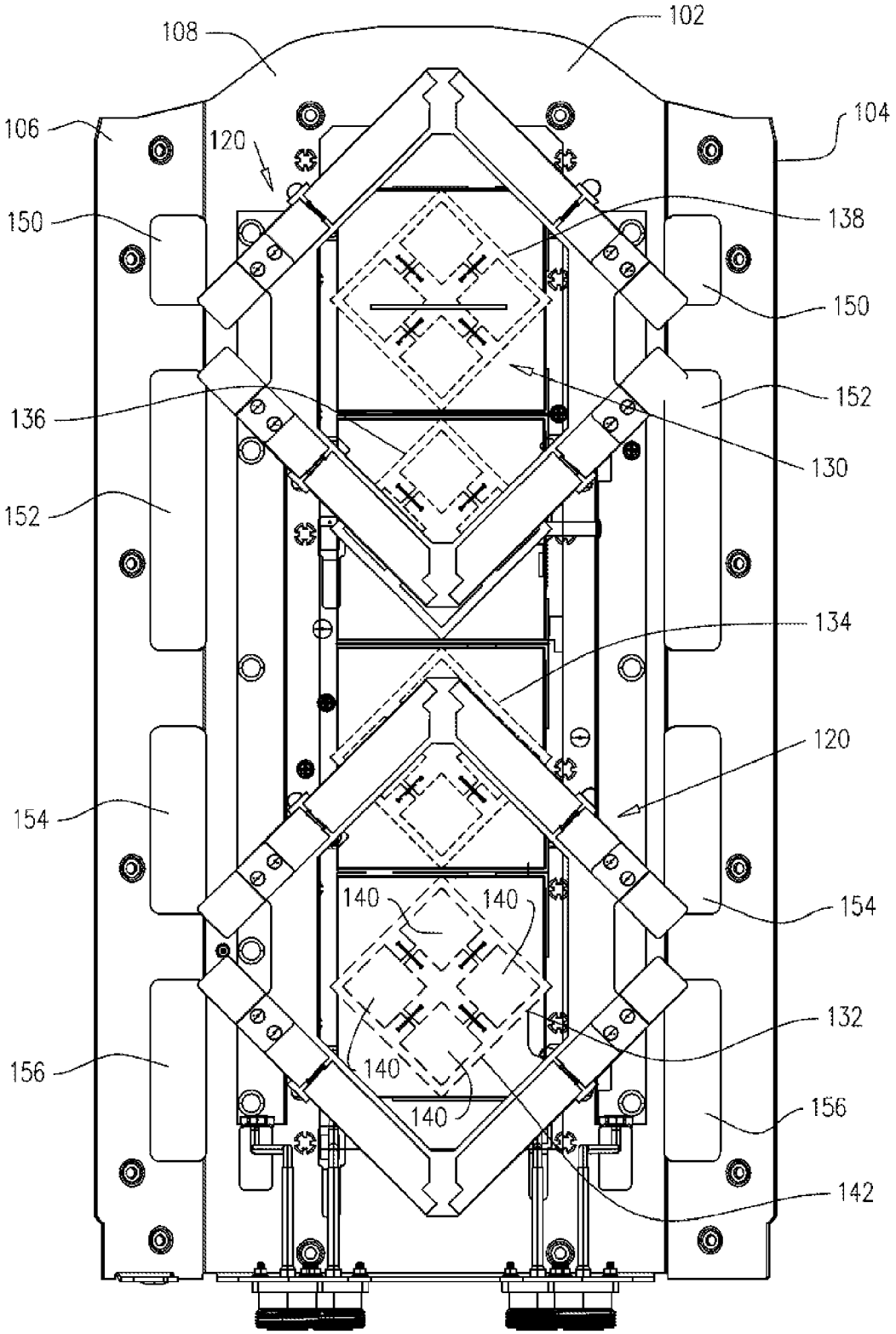
Figure 1C:
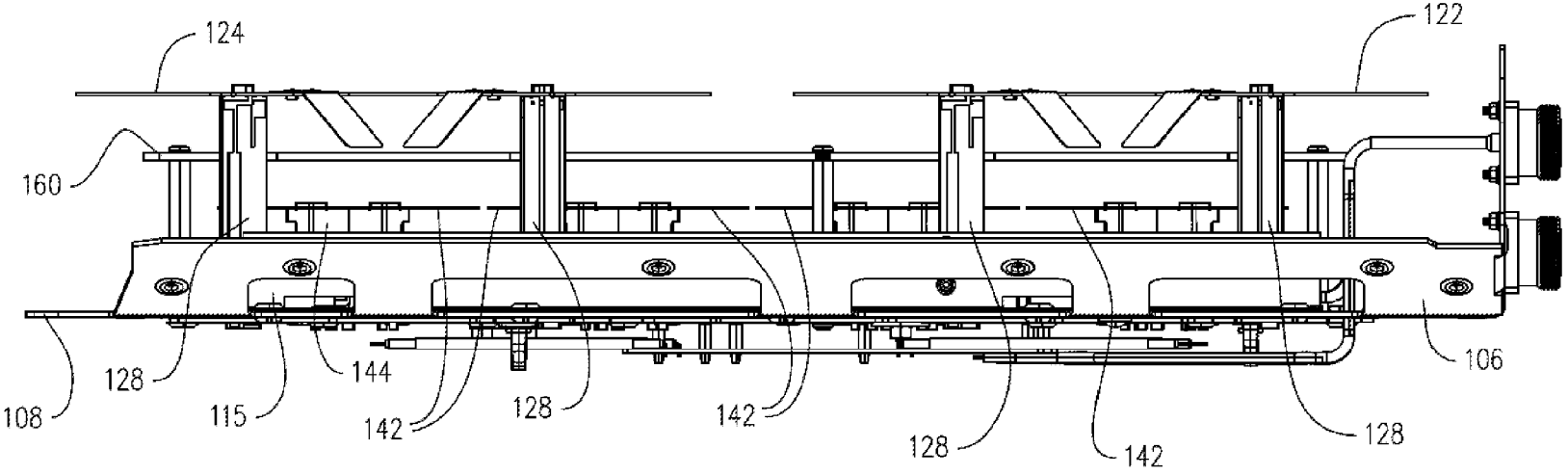

Reference is now made to FIGS. 1A, 1B and 1C, which are simplified respective perspective, top and side view illustrations of a multiband antenna constructed and operative in accordance with a preferred embodiment of the present invention.

As seen in FIGS. 1A-1C, there is provided an antenna 100, preferably including a ground plane 102 having at least one periphery, here embodied, by way of example, as a ground tray 102 having a first longitudinal periphery 104 and a second longitudinal periphery 106. As seen most clearly in FIG. 1A, ground tray 102 preferably includes a central planar portion 108 flanked on the longitudinal edges thereof by a first acutely angled portion 110 and a second acutely angled portion 112, which first and second acutely angled portions 110 and 112 preferably respectively form first and second longitudinal peripheries 104 and 106. It is appreciated, however, that first and second peripheries 104 and 106 may alternatively be co-planar with central planar portion 108 or may be orientated at a variety of other angles with respect to central planar portion 108, depending on the design and operating requirements of antenna 100.

At least one slot is preferably formed along at least one periphery of ground tray 102, here embodied, by way of example, as a first multiplicity of slots 114 preferably formed along first periphery 104 and a second multiplicity of slots 115 preferably formed along second periphery 106. Slots 114 and 115 are preferably non-radiative structures, serving to influence a bandwidth of radiation of antenna 100, as will be detailed henceforth.

A first plurality of radiating elements 120 is preferably mounted on ground plane 102 adjacent to the at least one periphery of ground plane 102. Here, by way of example, first plurality of radiating elements 120 is preferably located adjacent to and between first and second peripheries 104 and 106. First plurality of radiating elements 120 is preferably operative to radiate in a first frequency band. First plurality of radiating elements 120 is here embodied, by way of example, as a first quadrate dipole structure 122 and a second quadrate dipole structure 124, preferably mutually aligned along a central longitudinal axis of ground plane 102. Each one of first and second quadrate dipoles structures 122 and 124 preferably includes four dipole radiating elements 126, each one of which dipole radiating elements 126 is preferably supported by a dipole stem 128 mounted on ground plane 102. First and second quadrate dipole structures 122 and 124 preferably operate as dual-polarized radiating elements, having orthogonal polarizations of ±45°.

A second plurality of radiating elements 130 is preferably mounted on ground plane 102 adjacent to the at least one periphery of ground plane 102. Here, by way of example, second plurality of radiating elements 130 is preferably located adjacent to and between first and second peripheries 104 and 106. Second plurality of radiating elements 130 is preferably operative to radiate in a second frequency band, the second frequency band of radiation of second plurality of radiating elements 130 being higher than the first frequency band of radiation of first plurality of radiating elements 120. Here, by way of example, second plurality of radiating elements 130 is embodied as a first patch dipole structure 132, a second patch dipole structure 134, a third patch dipole structure 136 and a fourth patch dipole structure 138, which first-fourth patch dipoles structures 132-138 are preferably located beneath and centrally aligned with first plurality of radiating elements 120.

Each one of first-fourth patch dipole structures 132-138 is preferably generally of the type described in PCT Application Number PCT/IL2013/050266, assigned to the same assignee as the present invention. Each one of first-fourth patch dipole structures 132-138 preferably includes four interconnected patch radiating elements 140 disposed on a dielectric platform 142, which dielectric platform 142 is preferably mounted on ground plane 102 by way of a broad supporting leg 144, as seen most clearly in FIG. 1C. Each one of first, second, third and fourth patch dipole structures 132-138 preferably operates as dual-polarized radiating element, having orthogonal polarizations of ±45°.

Figure 4A:
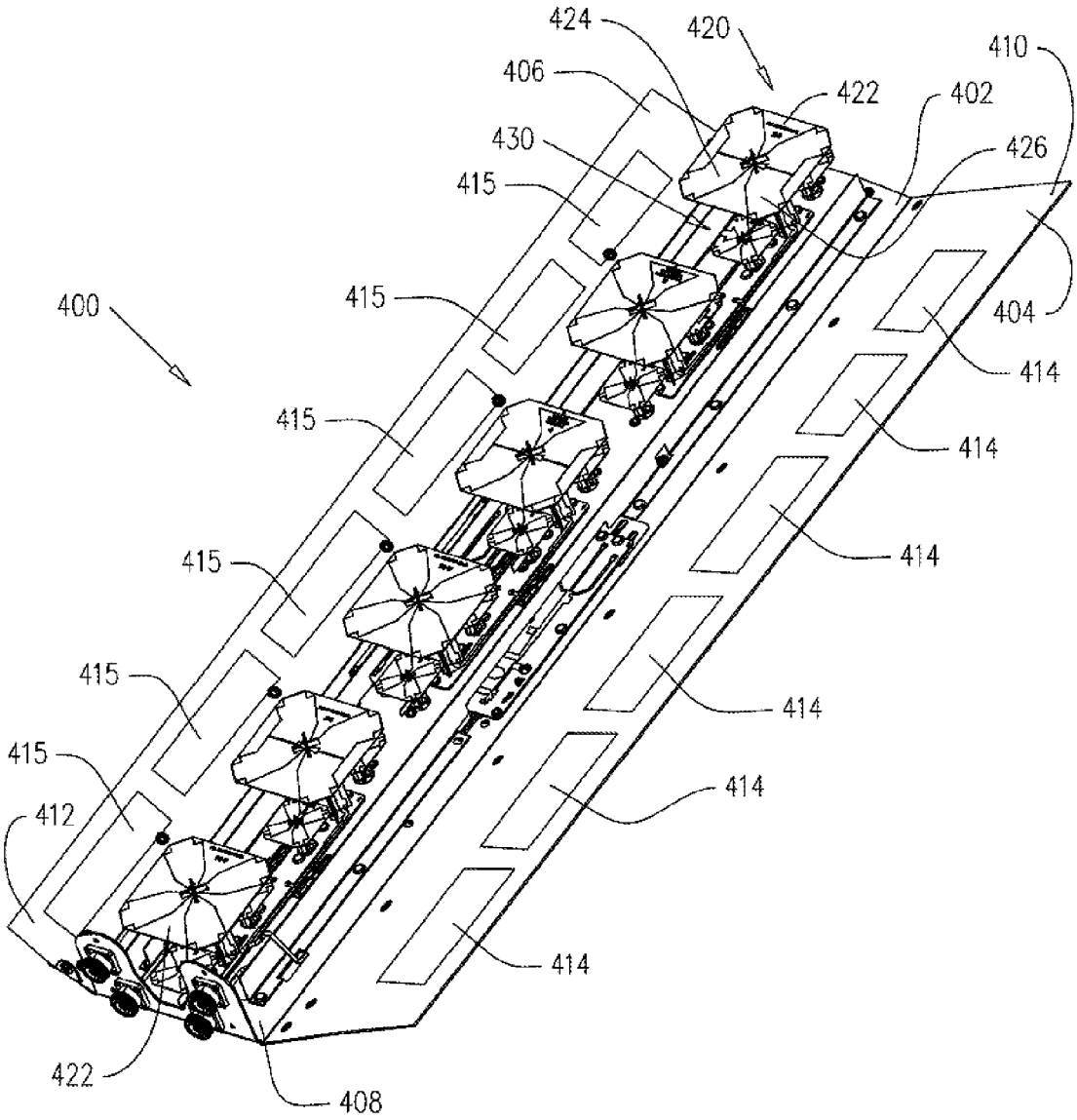
FIGS. 4A, 4B and 4C are simplified respective perspective, top and side view illustrations of a multiband antenna constructed and operative in accordance with a further preferred embodiment of the present invention.
Figure 4B:
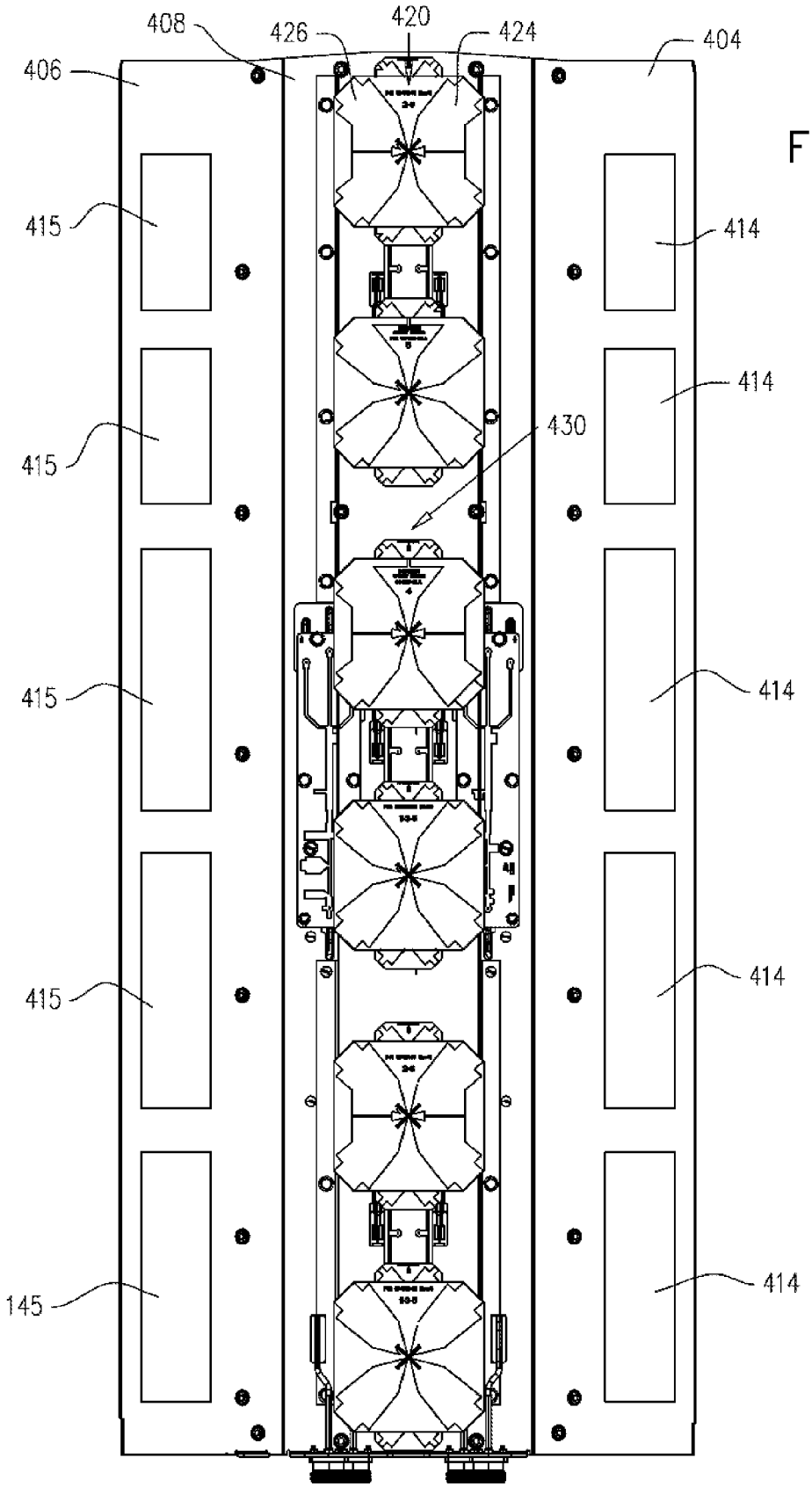
Figure 4C:
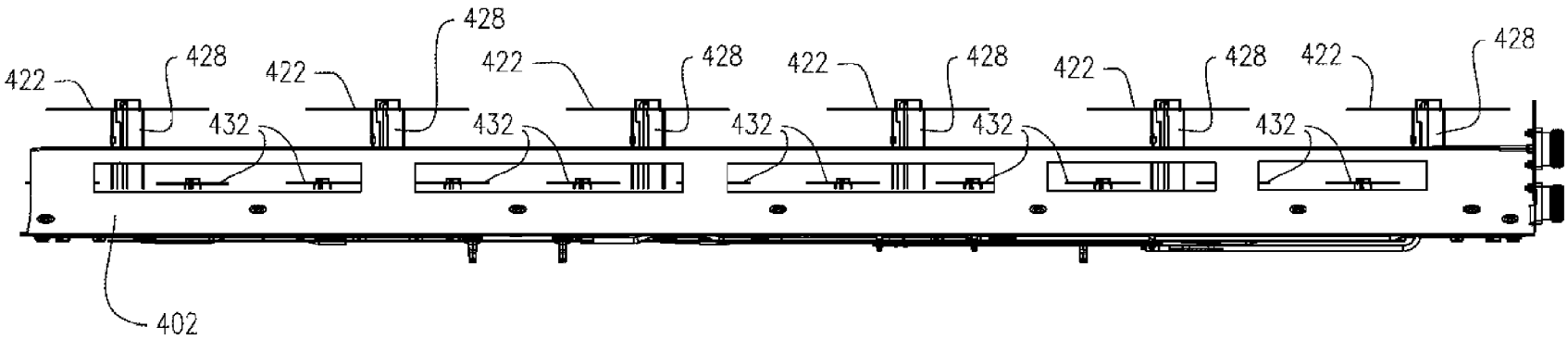

It is appreciated that the specific structures and configurations of first and second pluralities of radiating elements 120 and 130 shown in FIGS. 1A-1C are exemplary only and that first and second pluralities of radiating elements 120 and 130 may alternatively be embodied as a variety of other radiating elements, as will be exemplified henceforth with reference to FIGS. 4A-4C. It is further understood that first and second pluralities of radiating elements 120 and 130 may comprise a greater number of radiating elements than those illustrated in FIGS. 1A-1C, depending on a length of ground plane 102.

As best appreciated from consideration of FIG. 1C, second plurality of radiating elements 130 preferably has a smaller physical and hence electrical extent than first plurality of radiating elements 120. Second plurality of radiating elements 130 therefore radiates in a higher frequency band than first plurality of radiating elements 120. It is appreciated that antenna 100 may thus be termed a multi-band antenna, due to the inclusion therein of first and second pluralities of radiating elements 120 and 130 having different respective associated frequencies of operation. By way of example, first plurality of radiating elements 120 may operate over a low-frequency range spanning approximately 698-960 MHz and second plurality of radiating elements 130 may operate over a high-frequency range spanning approximately 1710-2700 MHz.

It is a particular feature of a preferred embodiment of the present invention that the presence of slots 114 and 115 in ground tray 102 serves to reduce the effective electrical width of ground tray 102 with respect to second plurality of high band radiating elements 130. As a result of the apparent reduction in the electrical width of ground tray 102 with respect to second plurality of high band radiating elements 130, a desired beam width of second plurality of high band radiating elements 130 may be achieved. A desired beam width of second plurality of high band radiating elements 130 may be at least 65° and preferably lies in the range of 65-85°. Were it not for the provision of slots 114 and 115, the relatively large electrical width of ground tray 102 with respect to the electrical dimensions of second plurality of high band radiating elements 130 would result in an undesirably narrow radiation beam of second plurality of radiating elements 130.

As seen most clearly in FIG. 1B, each one of first and second multiplicities of slots 114 and 115 is preferably embodied as a first slot 150, a second slot 152, a third slot 154 and a fourth slot 156, which first-fourth slots 150-156 are preferably located at intervals along first and second peripheries 104 and 106 of ground tray 102, such that slots 114 and 115 do not fully extend adjacent to a length of first plurality of low band radiating elements 120. Such an arrangement of slots 114 and 115 has been found to minimize the influence of slots 114 and 115 on the shape of a radiation beam of first plurality of low band radiating elements 120. Should slots 114 and 115 extend fully adjacent to a length of first plurality of low band radiating elements 120, slots 114 and 115 may disadvantageously narrow the effective electrical width of ground tray 102 with respect to first plurality of low band radiating elements 120, thus undesirably affecting the beam width of first plurality of low band radiating elements 120. A desired beam width of first plurality of low band radiating elements 120 may be at least 60° and preferably lies in the range of 60-85°.

It is hence appreciated that slots 114 and 115 are preferably sized so as to be functional to influence a beam width of radiation of second plurality of high band radiating elements 130 whilst having negligible influence on a beam width of radiation of first plurality of low band radiating elements 120. This is due to the different relative impedances presented by slots 114 and 115 with respect to first and second pluralities of radiating elements 120 and 130. Whereas slots 114 and 115 present a high impedance to second plurality of radiating elements 130, thereby effectively reducing the electrical width of ground tray 102 with respect thereto, slots 114 and 115 present a significantly smaller impedance to first plurality of radiating elements 120, due to the lower operating frequency thereof, thus only negligibly influencing the effective electrical width of ground tray 102 with respect thereto.

First slot 150 may have a length of approximately 39 mm, second slot 152 may have a length of approximately 121 mm, third slot 154 may have a length of approximately 154 mm and fourth slot 156 may have a length of approximately 79 mm. Such an arrangement of slots 114 and 115 has been found to render ground tray 102 particularly mechanically robust.

It is understood, however, that the particular configurations and dimensions of slots 114 and 115 shown in FIGS. 1A-1C are exemplary only and that the arrangement of slots 114 and 115 may be modified in accordance with the desired operating characteristics of antenna 100. In particular, it is appreciated that although slots 114 and 115 are shown to be arranged in a mutually symmetrical configuration along first and second acutely angled portions 110 and 112 of ground tray 102, other arrangements of slots 114 and 115, including mutually asymmetrical arrangements comprising a greater or fewer number of slots, are also possible. It is further appreciated that although slots 114 and 115 are shown to be arranged in a single row along respective first and second peripheries 104 and 106, slots 114 and 115 may alternatively be arranged in more than one row along first and/or second peripheries 104 and 106, depending on a width of ground tray 102, as will be exemplified henceforth with reference to FIGS. 3A-3C.

Antenna 100 may further include a dielectric slab 160, which dielectric slab 160 is preferably mounted on ground tray 102 overlying second plurality of radiating elements 130. Dielectric slab 160 preferably extends parallel to the plane defined by central planar portion 108 of ground tray 102 and is preferably formed by FR4. Dielectric slab 160 preferably serves to improve the radiation characteristics of antenna 100. It is appreciated, however, that the presence of dielectric slab 160 is optional and that dielectric slab 160 may be obviated, depending on the operating requirements of antenna 100.

A set of isolation strips 170 is preferably disposed on a surface of dielectric slab 160 in order to reduce mutual interference between the orthogonal ±45° polarizations of first and second pluralities of radiating elements 120 and 130 and hence improve the isolation therebetween. Isolation strips 170 are preferably embodied as a plurality of conductive strips, which strips may be printed, plated or otherwise disposed on a surface of dielectric slab 160. Isolation strips 170 are preferably arranged so as to be orthogonal to a longitudinal axis of dielectric slab 160 and ground tray 102.

Figure 2A:
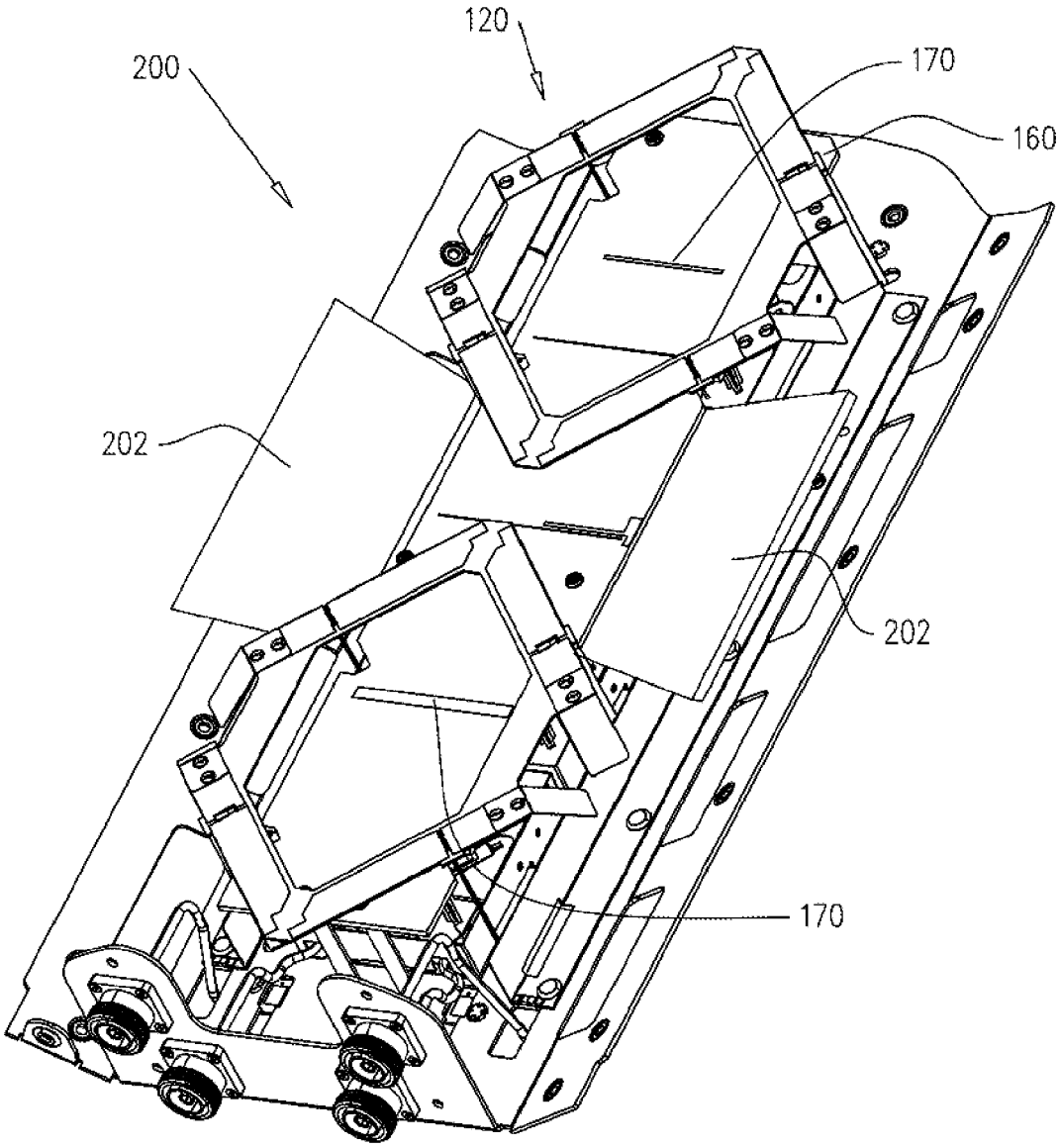
FIGS. 2A, 2B and 2C are simplified respective perspective, top and side view illustrations of a multiband antenna constructed and operative in accordance with another preferred embodiment of the present invention.
Figure 2B:
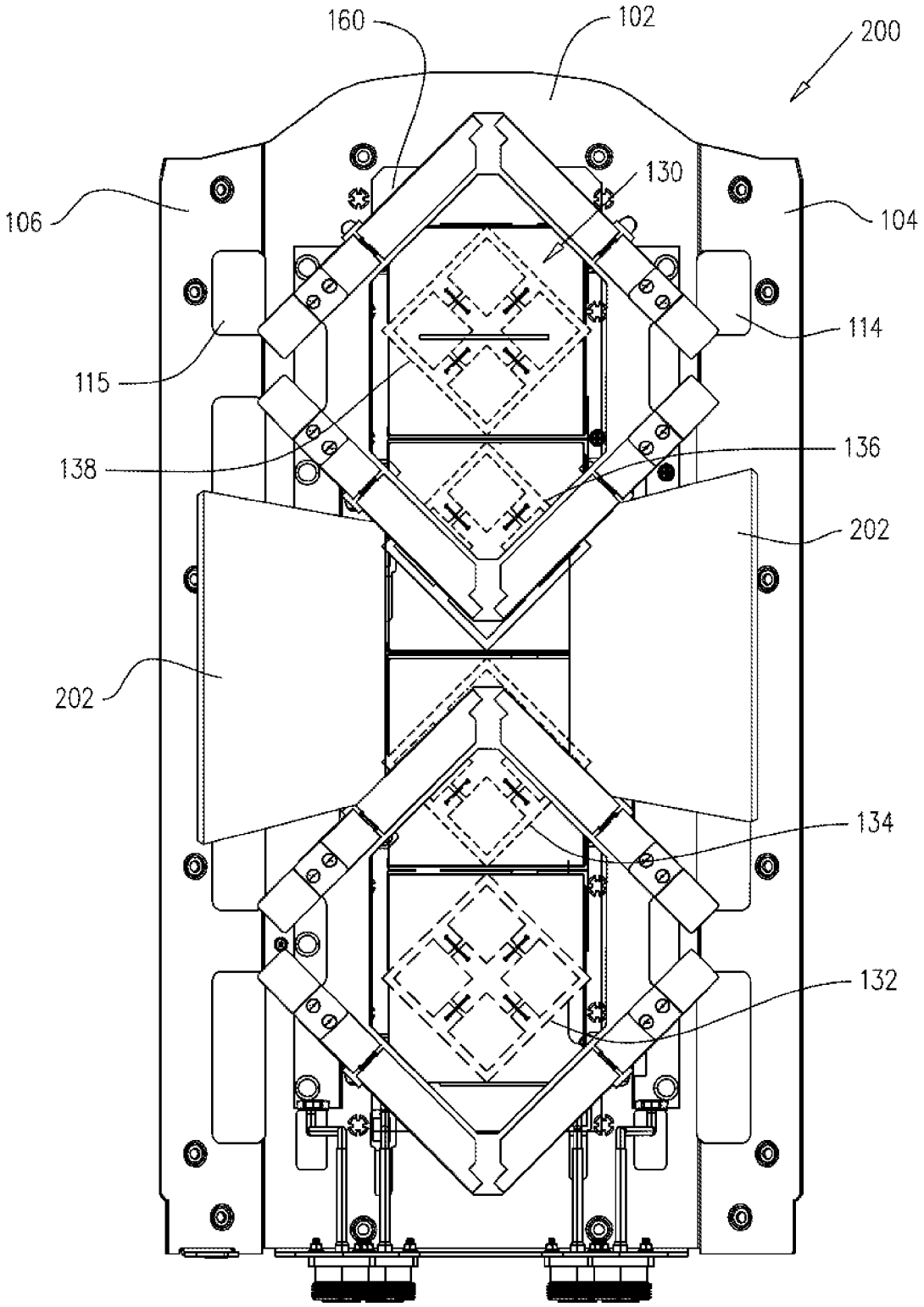
Figure 2C:
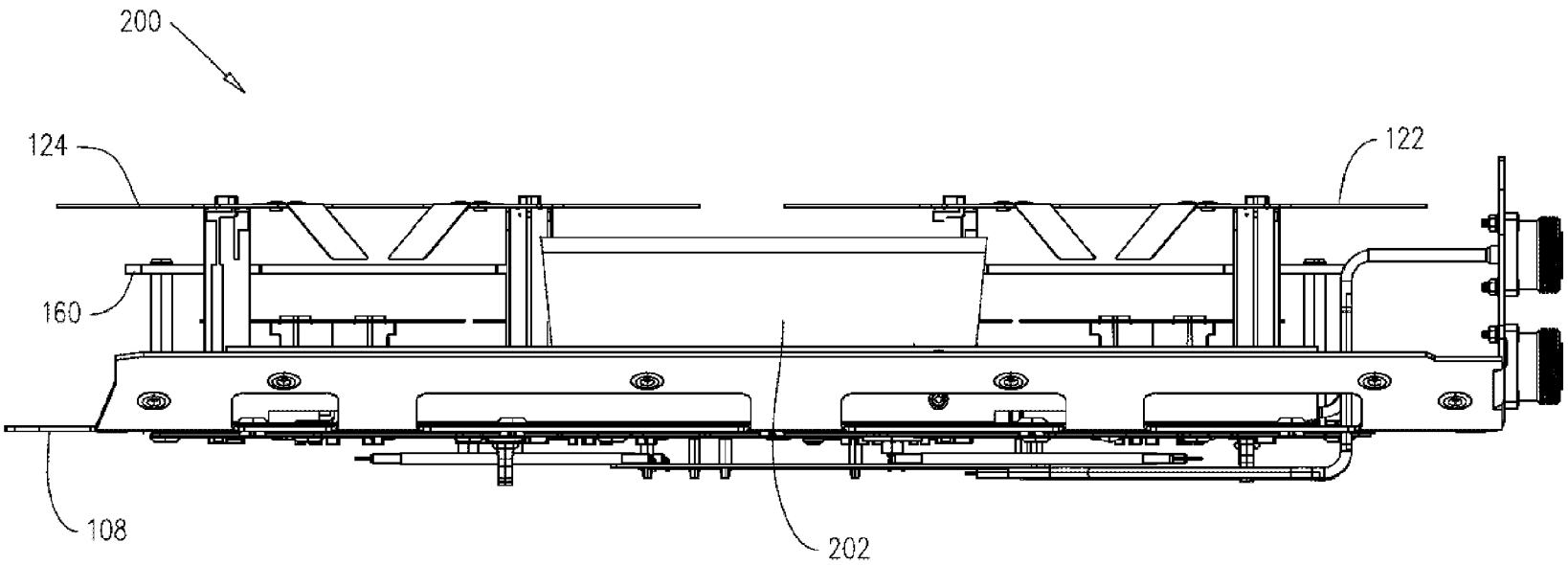

In the embodiment of dielectric slab 160 illustrated in FIGS. 1A-1C, dielectric slab 160 is shown to be a generally rectangular element having a uniform thickness. It is appreciated, however, that the particular configuration of dielectric slab 160 shown in FIGS. 1A-1C is exemplary only and may be readily modified by one skilled in the art, in accordance with the physical and operational requirements of antenna 100. Thus, by way of example, dielectric slab 160 may include a pair of wing-like extension portions protruding therefrom, as shown in the case of an antenna 200 illustrated in FIGS. 2A-2C, in which antenna 200 a pair of wing-like extension portions 202 preferably protrudes from dielectric slab 160. Wing-like extension portions 202 may have a greater thickness than other portions of dielectric slab 160. Particularly preferably, wing-like extension portions 202 may have a thickness approximately three times that of other portions of dielectric slab 160.

Multiband antenna 100 may be employed as an indoor or outdoor antenna and may be housed by a radome (not shown) when in use. Preferably, multiple ones of antenna 100 are mounted on a supporting pole and arranged in a back-to-back configuration. Particularly preferably, three ones of antenna 100 are mounted on a supporting pole and arranged in a back-to-back configuration, such that the individual ground trays of each one of the antennas 100 define an inner generally triangular cavity.

Figure 3A:
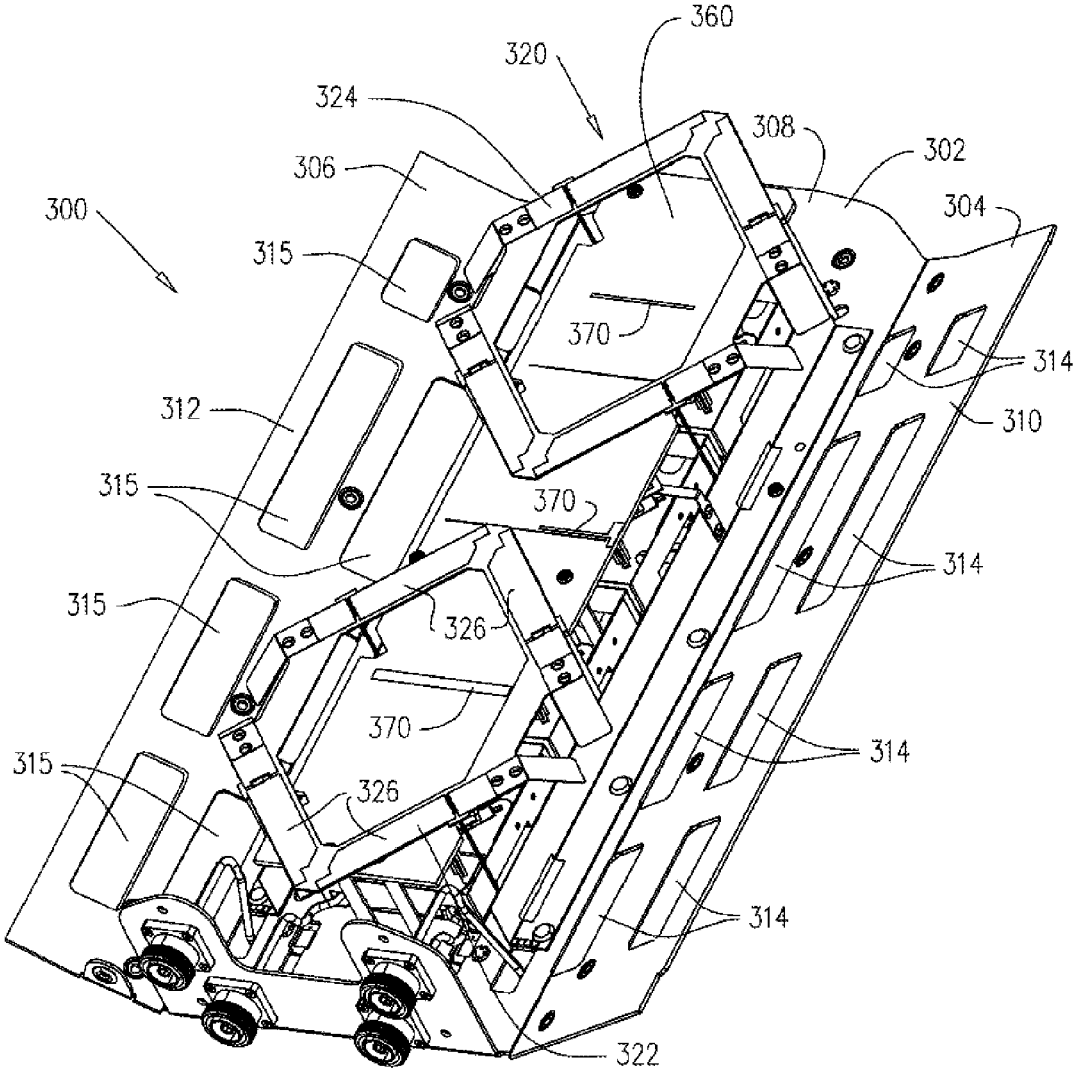
FIGS. 3A, 3B and 3C are simplified respective perspective, top and side view illustrations of a multiband antenna constructed and operative in accordance with yet another preferred embodiment of the present invention.
Figure 3B:
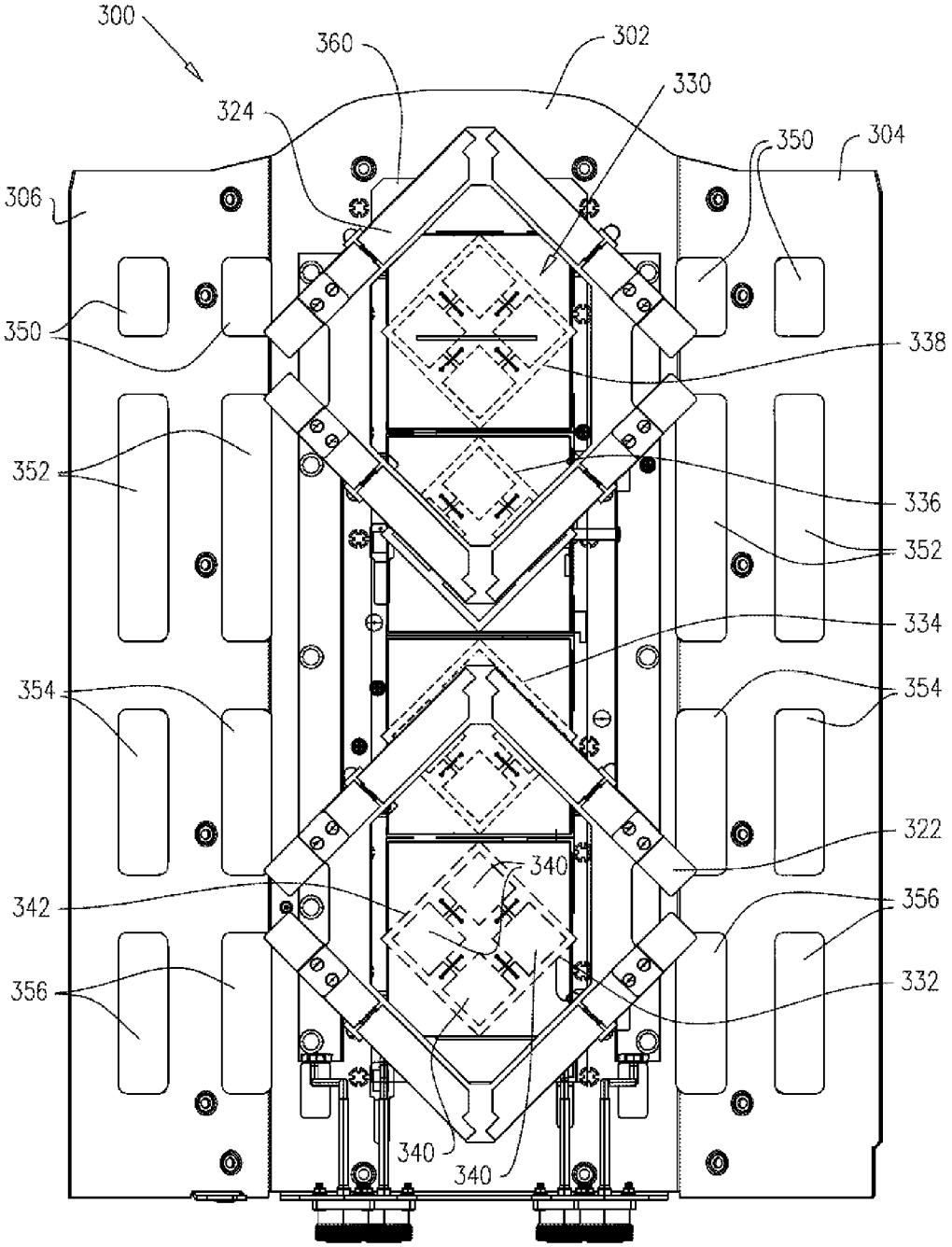
Figure 3C:
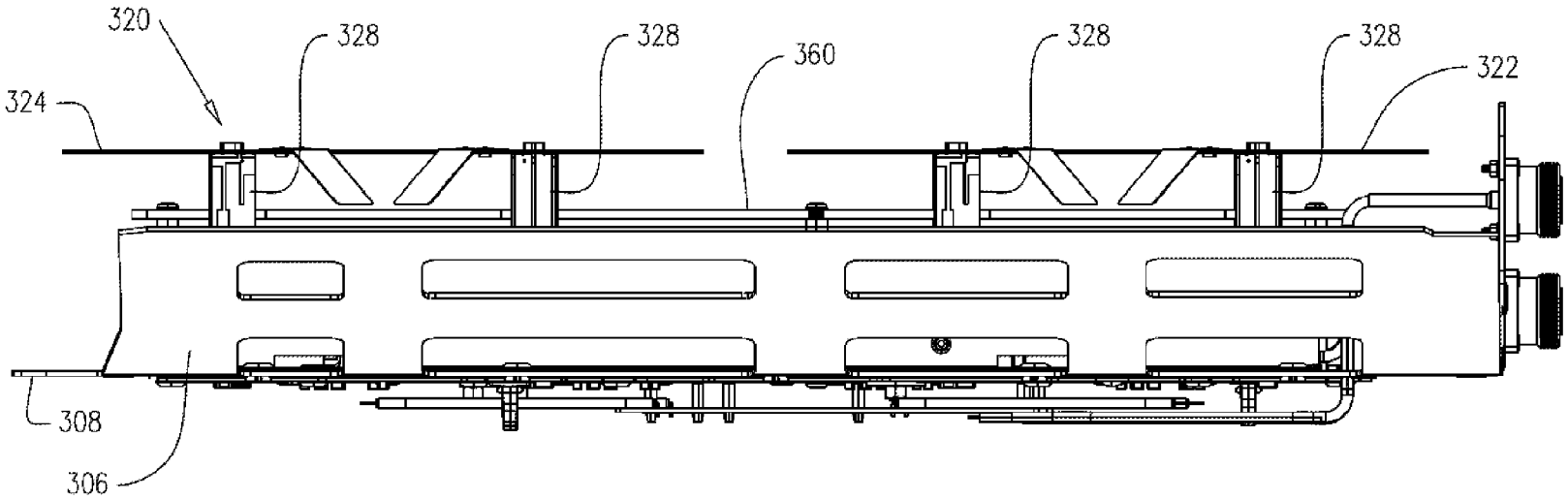

Reference is now made to FIGS. 3A-3C, which are simplified respective perspective, top and side view illustrations of a multiband antenna constructed and operative in accordance with yet another preferred embodiment of the present invention.

As seen in FIGS. 3A-3C, there is provided an antenna 300, preferably including a ground plane 302 having at least one periphery, here embodied, by way of example, as a ground tray 302 having a first longitudinal periphery 304 and a second longitudinal periphery 306. As seen most clearly in FIG. 3A, ground tray 302 preferably includes a central planar portion 308 flanked on the longitudinal edges thereof by a first acutely angled portion 310 and a second acutely angled portion 312, which first and second acutely angled portions 310 and 312 preferably respectively form first and second longitudinal peripheries 304 and 306. It is appreciated, however, that first and second peripheries 304 and 306 may alternatively be co-planar with central planar portion 308 or may be orientated at a variety of other angles with respect to central planar portion 308, depending on the design and operating requirements of antenna 300.

At least one slot is preferably formed along at least one periphery of ground tray 302, here embodied, by way of example, as a first multiplicity of slots 314 preferably arranged in two rows along first periphery 304 and a second multiplicity of slots 315 preferably arranged in two rows along second periphery 306. Slots 314 and 315 are preferably non-radiative structures, serving to influence a bandwidth of radiation of antenna 300, as will be detailed henceforth.

A first plurality of radiating elements 320 is preferably mounted on ground plane 302 adjacent to and between first and second peripheries 304 and 306. First plurality of radiating elements 320 is preferably operative to radiate in a first frequency band. First plurality of radiating elements 320 is here embodied, by way of example, as a first quadrate dipole structure 322 and a second quadrate dipole structure 324, preferably mutually aligned along a central longitudinal axis of ground plane 302. Each one of first and second quadrate dipoles structures 322 and 324 preferably includes four dipole radiating elements 326, each one of which dipole radiating elements 326 is preferably supported by a dipole stem 328 mounted on ground plane 302. First and second quadrate dipole structures 322 and 324 preferably operate as dual-polarized radiating elements, having orthogonal polarizations of ±45°.

A second plurality of radiating elements 330 is preferably mounted on ground plane 302 adjacent to and between first and second peripheries 304 and 306. Second plurality of radiating elements 330 is preferably operative to radiate in a second frequency band, the second frequency band of radiation of second plurality of radiating elements 330 being higher than the first frequency band of radiation of first plurality of radiating elements 320. Here, by way of example, second plurality of radiating elements 330 is embodied as a first patch dipole structure 332, a second patch dipole structure 334, a third patch dipole structure 336 and a fourth patch dipole structure 338, which first-fourth patch dipole structures 332-338 are preferably located beneath and centrally aligned with first plurality of radiating elements 320.

Each one of first-fourth patch dipole structures 332-338 is preferably generally of the type described in PCT Application Number PCT/IL2013/050266, assigned to the same assignee as the present invention. Each one of first-fourth patch dipole structures 332-338 preferably includes four interconnected patch radiating elements 340 disposed on a dielectric platform 342, which dielectric platform 342 is preferably mounted on ground plane 302 by way of a broad supporting leg. Each one of first, second, third and fourth patch dipole structures 332-338 preferably operates as dual-polarized radiating element, having orthogonal polarizations of ±45°.

It is appreciated that the specific structures and configurations of first and second pluralities of radiating elements 320 and 330 shown in FIGS. 3A-3C are exemplary only and that first and second pluralities of radiating elements 320 and 330 may alternatively be embodied as a variety of other radiating elements. It is further understood that first and second pluralities of radiating elements 320 and 330 may comprise a greater number of radiating elements than those illustrated in FIGS. 3A-3C, depending on a length of ground plane 302.

As best appreciated from consideration of FIG. 3C, second plurality of radiating elements 330 preferably has a smaller physical and hence electrical extent than first plurality of radiating elements 320. Second plurality of radiating elements 330 therefore radiates in a higher frequency band than first plurality of radiating elements 320. It is appreciated that antenna 300 may thus be termed a multi-band antenna, due to the inclusion therein of first and second pluralities of radiating elements 320 and 330 having difference respective associated frequencies of operation. By way of example, first plurality of radiating elements 320 may operate over a low-frequency range spanning approximately 698-960 MHz and second plurality of radiating elements 330 may operate over a high-frequency range spanning approximately 1710-2700 MHz.

It is a particular feature of a preferred embodiment of the present invention that the presence of slots 314 and 315 in ground tray 302 serves to reduce the effective electrical width of ground tray 302 with respect to second plurality of high band radiating elements 330. As a result of the apparent reduction in the electrical width of ground tray 302 with respect to second plurality of high band radiating elements 330, a desired beam width of second plurality of high band radiating elements 330 may be achieved. A desired beam width of second plurality of high band radiating elements 330 may be at least 65° and preferably lies in the range of 65-85. Were it not for the provision of slots 314 and 315, the relatively large electrical width of ground tray 302 with respect to the electrical dimensions of second plurality of high band radiating elements 330 would result in an undesirably narrow radiation beam of second plurality of radiating elements 330.

As seen most clearly in FIG. 3B, slots 314 and 315 are preferably embodied as a first pair of slots 350, a second pairs of slots 352, a third pair of slots 354 and a fourth pair of slots 356, which first-fourth pairs of slots 350-356 are preferably arranged in two parallel rows and located at intervals along each one of first and second peripheries 304 and 306 of ground tray 302, such that slots 314 and 315 do not fully extend adjacent to a length of first plurality of low band radiating elements 320. Such an arrangement of slots 314 and 315 has been found to minimize the influence of slots 314 and 315 on the shape of a radiation beam of first plurality of low band radiating elements 320. Should slots 314 and 315 extend fully adjacent to a length of first plurality of low band radiating elements 320, slots 314 and 315 may disadvantageously narrow the apparent electrical width of ground tray 302 with respect to first plurality of low band radiating elements 320, thus undesirably affecting the beam width of first plurality of low band radiating elements 320. A desired beam width of first plurality of low band radiating elements 320 may be at least 60° and preferably lies in the range of 60-85°.

It is hence appreciated that slots 314 and 315 are preferably sized so as to be functional to influence a beam width of radiation of second plurality of high band radiating elements 330 whilst having negligible influence on a beam width of radiation of first plurality of low band radiating elements 320. This is due to the different impedances presented by slots 314 and 315 with respect to first and second pluralities of radiating elements 320 and 330. Whereas slots 314 and 315 present a high impedance with respect to second plurality of radiating elements 330, thereby effectively reducing the electrical width of ground tray 302 with respect thereto, slots 314 and 315 present a significantly smaller impedance with respect to first plurality of radiating elements 320, due to the lower operating frequency thereof, thus only negligibly influencing the effective electrical width of ground tray 302 with respect thereto.

Each slot of first pair of slots 350 may have a length of approximately 39 mm, each slot of second pair of slots 352 may have a length of approximately 121 mm, each slot of third pair of slots 354 may have a length of approximately 154 mm and each slot of fourth pair of slots 356 may have a length of approximately 79 mm. Such an arrangement of slots 314 and 315 has been found to render ground tray 302 particularly mechanically robust.

It is appreciated that antenna 300 may thus resemble antenna 100 in every relevant respect with exception of in the arrangement of slots 314 and 315 along peripheries 304 and 306. Whereas in antenna 100 slots 114 and 115 are preferably respectively arranged in a single row along peripheries 104 and 106, in antenna 300 slots 314 and 315 are preferably respectively arranged in two rows along peripheries 304 and 306. This difference in arrangement of slots 314 and 315 in comparison to slots 114 and 115 arises due to the greater width of peripheral portions 310 and 312 in comparison to that of peripheral portions 110 and 112. Due to the greater width of peripheral portions 310 and 312 in antenna 300, multiple rows of slots 314 and 315 may be formed therealong.

It is appreciated that slots 314 and 315 are not limited to being arranged in only one or two rows along the peripheries 304 and 306 of ground plane 302. Should the width of peripheries 304 and 306 of ground plane 302 be sufficiently large, greater numbers of rows of slots 314 and 315 may be formed therealong.

Antenna 300 may further include a dielectric slab 360, which dielectric slab 360 is preferably located overlying second plurality of radiating elements 330. Dielectric slab 360 preferably extends parallel to the plane defined by central planar portion 308 of ground tray 302 and is preferably formed by FR4. Dielectric slab 360 preferably serves to improve the radiation characteristics of antenna 300. It is appreciated, however, that the presence of dielectric slab 360 is optional and that dielectric slab 360 may be obviated, depending on the operating requirements of antenna 300.

A set of isolation strips 370 is preferably disposed on a surface of dielectric slab 360 in order to reduce mutual interference between the orthogonal ±45° polarizations of first and second pluralities of radiating elements 320 and 330 and hence improve the isolation therebetween. Isolation strips 370 are preferably embodied as conductive strips, which strips may be printed, plated or otherwise disposed on a surface of dielectric slab 360. Isolation strips 370 are preferably arranged so as to be orthogonal to a longitudinal axis of dielectric slab 360 and ground tray 302.

In the embodiment of dielectric slab 360 illustrated in FIGS. 3A-3C, dielectric slab 360 is shown to be a generally rectangular element having a uniform thickness. It is appreciated, however, that the particular configuration of dielectric slab 360 shown in FIGS. 3A-3C is exemplary only and may be readily modified by one skilled in the art, in accordance with the physical and operating requirements of antenna 300.

Multiband antenna 300 may be employed as an indoor or outdoor antenna and may be housed by a radome (not shown) when in use. Preferably, multiple ones of antenna 300 are mounted on a supporting pole and arranged in a back-to-back configuration. Particularly preferably, three ones of antenna 300 are mounted on a supporting pole and arranged in a back-to-back configuration, such that the individual ground trays of each one of the antennas 300 define an inner generally triangular cavity.

Reference is now made to FIGS. 4A-4C, which are simplified respective perspective, top and side view illustrations of a multiband antenna constructed and operative in accordance with a further preferred embodiment of the present invention.

As seen in FIGS. 4A-4C, there is provided an antenna 400, preferably including a ground plane 402 having at least one periphery, here embodied, by way of example, as a ground tray 402 having a first longitudinal periphery 404 and a second longitudinal periphery 406. As seen most clearly in FIG. 4A, ground tray 402 preferably includes a central planar portion 408 flanked on the longitudinal edges thereof by a first acutely angled portion 410 and a second acutely angled portion 412, which first and second acutely angled portions 410 and 412 preferably respectively form first and second longitudinal peripheries 404 and 406. It is appreciated, however, that first and second peripheries 404 and 406 may alternatively be co-planar with central planar portion 408 or may be orientated at a variety of other angles with respect to central planar portion 408, depending on the design and operating requirements of antenna 400.

At least one slot is preferably formed along at least one periphery of ground tray 402, here embodied, by way of example, as a first multiplicity of slots 414 preferably formed along first periphery 404 and a second multiplicity of slots 415 preferably formed along second periphery 406. Slots 414 and 415 are preferably non-radiative structures, serving to influence a bandwidth of radiation of antenna 400, as will be detailed henceforth.

A first plurality of radiating elements 420 is preferably mounted on ground plane 402 adjacent to and between first and second peripheries 404 and 406. First plurality of radiating elements 420 is preferably operative to radiate in a first frequency band. First plurality of radiating elements 420 is here embodied, by way of example, as six crossed-dipole structures 422, preferably mutually aligned along a central longitudinal axis of ground plane 402. Each one of crossed-dipole structures 422 preferably includes a first dipole 424 and a second dipole 426 intersecting first dipole 424 and orthogonally arranged with respect thereto. Each one of crossed-dipole structures 422 is preferably supported by a dipole stem 428 mounted on ground plane 402. Each one of crossed-dipole structures 422 preferably operates as dual-polarized radiating element, having orthogonal polarizations of ±45°.

A second plurality of radiating elements 430 is preferably mounted on ground plane 402 adjacent to and between first and second peripheries 404 and 406. Second plurality of radiating elements 430 is preferably operative to radiate in a second frequency band, the second frequency band of radiation of second plurality of radiating elements 430 being higher than the first frequency band of radiation of first plurality of radiating elements 420. Here, by way of example, second plurality of radiating elements 430 is embodied as twelve crossed-dipole structures 432, arranged in pairs on either side of each one of six crossed-dipole structures 422. Second plurality of radiating elements 430 preferably generally resembles first plurality of radiating elements 420 but has a smaller size in comparison thereto.

Each one of second plurality of radiating elements 430 preferably operates as dual-polarized radiating element, having orthogonal polarizations of ±45° and is preferably mounted on ground tray 402. It is appreciated that the specific structures and configurations of first and second pluralities of radiating elements 420 and 430 shown in FIGS. 4A-4C are exemplary only and that first and second pluralities of radiating elements 420 and 430 may alternatively be embodied as a variety of other radiating elements. It is further understood that first and second pluralities of radiating elements 420 and 430 may comprise a greater or fewer number of radiating elements than those illustrated in FIGS. 4A-4C, depending on a length of ground plane 402.

As best appreciated from consideration of FIG. 4C, second plurality of radiating elements 430 preferably has a smaller physical and hence electrical extent than first plurality of radiating elements 420. Second plurality of radiating elements 430 therefore radiates in a higher frequency band than first plurality of radiating elements 420. It is appreciated that antenna 400 may thus be termed a multiband antenna, due to the inclusion therein of first and second pluralities of radiating elements 420 and 430 having difference respective associated frequencies of operation. By way of example, first plurality of radiating elements 420 may operate over a low-frequency range spanning approximately 698-960 MHz and second plurality of radiating elements 430 may operate over a high-frequency range spanning approximately 1710-2700 MHz.

It is a particular feature of a preferred embodiment of the present invention that the presence of slots 414 and 415 in ground tray 402 serves to reduce the effective electrical width of ground tray 402 with respect to second plurality of high band radiating elements 430. As a result of the apparent reduction in the electrical width of ground tray 402 with respect to second plurality of high band radiating elements 430, a desired beam width of second plurality of high band radiating elements 430 may be achieved. A desired beam width of second plurality of high band radiating elements 430 may be at least 65° and preferably lies in the range of 65-85°. Were it not for the provision of slots 414 and 415, the relatively large electrical width of ground tray 402 with respect to the electrical dimensions of second plurality of high band radiating elements 430 would result in an undesirably narrow radiation beam of second plurality of radiating elements 430.

As seen most clearly in FIG. 4B, slots 414 and 415 are preferably located at intervals along first and second peripheries 404 and 406 of ground tray 402, such that slots 414 and 415 do not fully extend adjacent to a length of first plurality of low band radiating elements 420. Such an arrangement of slots 414 and 415 has been found to minimize the influence of slots 414 and 415 on the shape of a radiation beam of first plurality of low band radiating elements 420. Should slots 414 and 415 extend fully adjacent to a length of first plurality of low band radiating elements 420, slots 414 and 415 may disadvantageously narrow the apparent electrical width of ground tray 402 with respect to first plurality of low band radiating elements 420, thus undesirably affecting the beam width of first plurality of low band radiating elements 420. A desired beam width of first plurality of low band radiating elements 420 may be at least 60° and preferably lies in the range of 60-85°.

It is hence appreciated that slots 414 and 415 are preferably sized so as to be functional to influence a beam width of radiation of second plurality of high band radiating elements 430 whilst having negligible influence on a beam width of radiation of first plurality of low band radiating elements 420. This is due to the different impedances presented by slots 414 and 415 with respect to first and second pluralities of radiating elements 420 and 430. Whereas slots 414 and 415 present a high impedance to second plurality of radiating elements 430, thereby effectively reducing the electrical width of ground tray 402 with respect thereto, slots 414 and 415 present a significantly smaller impedance to first plurality of radiating elements 420, due to the lower operating frequency thereof, thus only negligibly influencing the effective electrical width of ground tray 402 with respect thereto.

It is understood that the particular configurations of slots 414 and 415 shown in FIGS. 4A-4C are exemplary only and that the arrangement of slots 414 and 415 may be modified in accordance with the desired operating characteristics of antenna 400. In particular, it is appreciated that although slots 414 and 415 are shown to be arranged in a mutually symmetrical configuration along first and second acutely angled portions 410 and 412 of ground tray 402 in FIGS. 4A-4C, other arrangements of slots 414 and 415, including mutually asymmetrical arrangements comprising a greater or fewer number of slots 414 and 415, are also possible and are included in the scope of the present invention. It is further appreciated that although slots 414 and 415 are shown to be arranged in a single row along first and second peripheries 404 and 406, slots 414 and 415 may alternatively be arranged in more than one row along first and/or second peripheries 404 and 406, depending on a width of ground tray 402.

Multiband antenna 400 may be employed as an indoor or outdoor antenna and may be housed by a radome (not shown) when in use. Preferably, multiple ones of antenna 400 are mounted on a supporting pole and arranged in a back-to-back configuration. Particularly preferably, three ones of antenna 400 are mounted on a supporting pole and arranged in a back-to-back configuration, such that the individual ground trays of each one of the antennas 400 define an inner generally triangular cavity.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. A multiband antenna comprising:

a ground plane having at least one periphery, at least one non-radiative slot being formed along said at least one periphery;

wherein said at least one periphery comprises a first longitudinal periphery and a second longitudinal periphery, and said ground plane comprises a central planar portion having fixed acutely angled edges, said fixed acutely angled edges comprising the first longitudinal periphery and the second longitudinal periphery;

wherein a location of the at least one non-radiative slot on the at least one periphery and a length of the at least one non-radiative slot widen the second beam width, and said at least one non-radiative slot comprises a first multiplicity of non-radiative slots formed along said first longitudinal periphery and a second multiplicity of non-radiative slots formed along said second longitudinal periphery;

a first plurality of radiating elements mounted on said ground plane adjacent to said at least one periphery and radiating in a first frequency band and having a first beam width; and a second plurality of radiating elements mounted on said ground plane adjacent to said at least one periphery and radiating in a second frequency band, said second frequency band being higher than said first frequency band, and having a second beam width.

2. A multiband antenna according to claim 1, wherein each one of said first and second multiplicities of non-radiative slots comprises at least a single row of slots.

3. A multiband antenna according to claim 2, wherein said at least single row of slots comprises two parallel rows of slots.

4. A multiband antenna according to claim 1, wherein said first plurality of radiating elements comprises a plurality of dual-polarized dipole radiating elements.

5. A multiband antenna according to claim 4, wherein said second plurality of radiating elements comprises a plurality of dual-polarized dipole radiating elements.

6. A multiband antenna according to claim 5, wherein said first and second pluralities of radiating elements are of the same type.

7. A multiband antenna according to claim 5, wherein said first and second pluralities of radiating elements comprise different types of radiating elements.

8. A multiband antenna according to claim 5, wherein said second plurality of radiating elements operates over a frequency range of 1710-2700 MHz.

9. A multiband antenna according to claim 4, wherein said first plurality of radiating elements operates over a frequency range of 690-960 MHz.

10. A multiband antenna according to claim 1, wherein said at least one non-radiative slot has a negligible influence on said first beam width.

11. A multiband antenna according to claim 10, wherein said first beam width is equal to or greater than 60°.

12. A multiband antenna according to claim 11, wherein said second beam width is equal to or greater than 65°.

13. A multiband antenna according to claim 1, and also comprising a dielectric element mounted on said ground plane and overlying said second plurality of radiating elements.

14. A multiband antenna according to claim 13, wherein a plurality of conductive isolation strips is formed on said dielectric element.

15. A multiband antenna according to claim 13, wherein said dielectric element comprises a generally rectangular element having a pair of wing-like extensions protruding therefrom.

16. A multiband antenna according to claim 15, wherein a thickness of said pair of wing-like extensions is greater than a thickness of said generally rectangular element.

17. A multiband antenna according to claim 1, wherein said multiband antenna is housed by a radome.

* * * * *